US007152381B2

(12) United States Patent
Hasley

(10) Patent No.: US 7,152,381 B2
(45) Date of Patent: Dec. 26, 2006

(54) BUILDING WITH TRIANGULAR FACADES

(76) Inventor: Raymond G. Hasley, 1815 Ocean Village Ave., Amelia Island, FL (US) 32034

( * ) Notice: Subject to any disclaimer, the term of this patent is extended or adjusted under 35 U.S.C. 154(b) by 0 days.

(21) Appl. No.: 11/146,845

(22) Filed: Jun. 7, 2005

(65) Prior Publication Data

US 2005/0246970 A1 Nov. 10, 2005

Related U.S. Application Data

(63) Continuation of application No. 10/609,169, filed on Jun. 27, 2003, now abandoned.

(51) Int. Cl.
*E04C 1/00* (2006.01)

(52) U.S. Cl. ..... 52/561; 52/311.1; 52/608; 52/609; 446/85

(58) Field of Classification Search ..... 52/81.4, 52/81.1, DIG. 10, 652.1, 311.1, 561, 608, 52/609; 273/157 R, 153 R; D25/23–26, D25/29; D21/478, 108; 446/85, 97, 117, 446/125, 128, 122, 105, 106, 118, 476, 487
See application file for complete search history.

(56) References Cited

U.S. PATENT DOCUMENTS 2,241,830 A 5/1941 Tourtellotte
3,585,752 A * 6/1971 Howe ..... 446/127
3,722,153 A * 3/1973 Baer ..... 52/81.2
3,724,147 A 4/1973 Levenson
3,913,285 A 10/1975 Helfrich
3,965,626 A * 6/1976 Johnson ..... 52/79.3
4,594,825 A 6/1986 Lamaraca
4,608,653 A * 8/1986 Setoguchi ..... 345/419
4,723,382 A * 2/1988 Lalvani ..... 52/81.1
4,736,550 A * 4/1988 Hawranick ..... 52/574
4,807,418 A 2/1989 Ferguson et al.
5,261,194 A * 11/1993 Roberts ..... 52/81.1
5,524,396 A * 6/1996 Lalvani ..... 52/81.1
5,762,529 A * 6/1998 Nizza ..... 446/85
6,027,117 A * 2/2000 Goldberg ..... 273/157 R
6,076,318 A * 2/2000 Grimm et al. ..... 52/245
6,186,856 B1 * 2/2001 Chen ..... 446/128

* cited by examiner

*Primary Examiner*—Jeanette Chapman
(74) *Attorney, Agent, or Firm*—Clifford A. Poff

(57) ABSTRACT

A building uses three or more triangular facades arranged in a serial array formed by one triangular facade jutting from side face boundaries of each of the abutted and side-by-side triangular facades. The triangular facades configured similarly are in a dispersed serial arrangement about an elongated central axis. One triangular façade is the larger of triangular facades and all facades have a triangularly shaped outer facing wall bounded by an endless succession of perimeter walls in a right triangle relation. The arrangement permits multiple triangular façades configured to harmonize with level or undulating terrain.

35 Claims, 9 Drawing Sheets

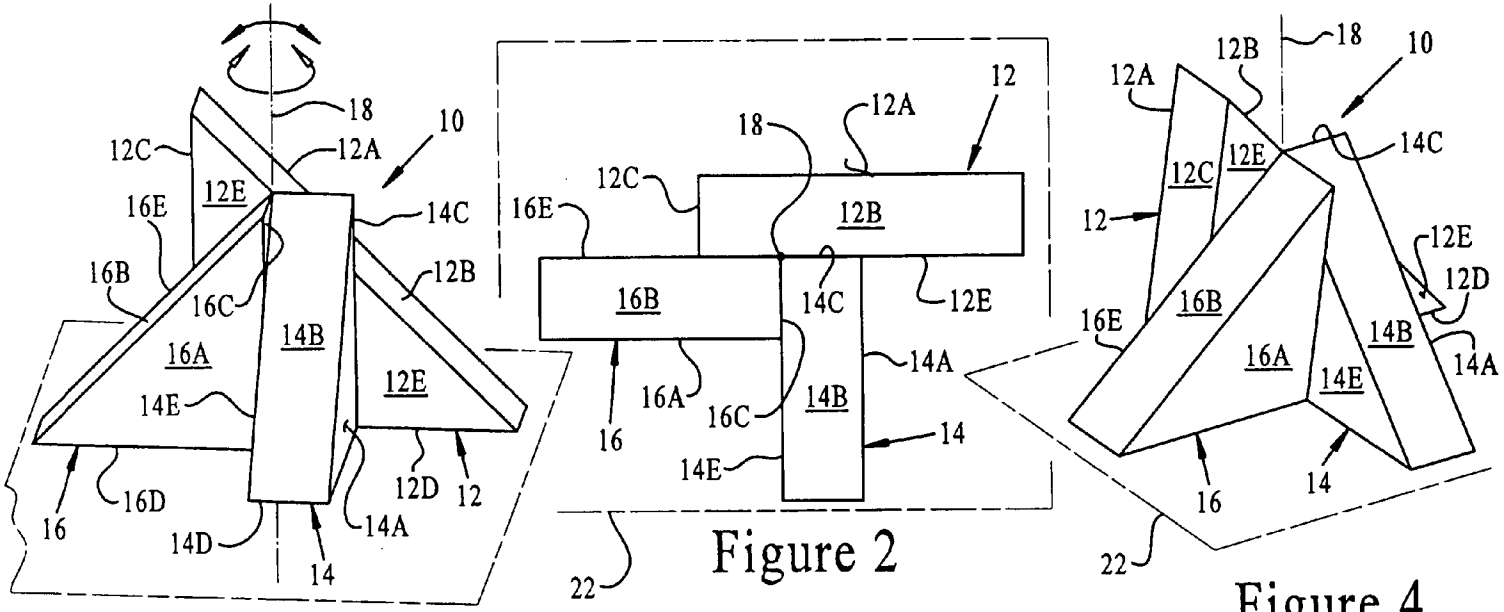
Figure 3
Figure 2
Figure 4
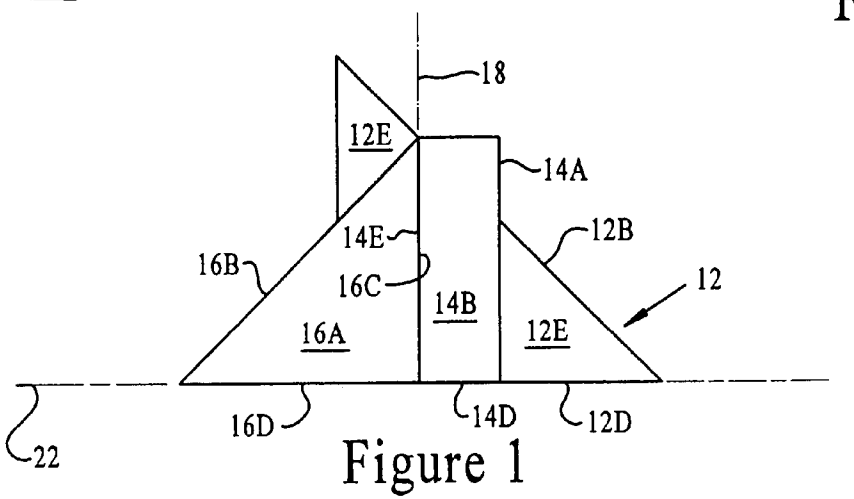
Figure 1

BUILDING WITH TRIANGULAR FACADES

CROSS-REFERENCE TO RELATED APPLICATIONS

This application is a continuation of patent application Ser. No. 10/609,169, filed Jun. 27, 2003 now abandoned.

BACKGROUND OF THE INVENTION

1. Field of the Invention

The present invention relates to an architectural design for a versatile modern building structure to esthetically and functionally harmonize the building structure with the topography of the land bearing the building structure, and, more particularly, to such an architectural design featuring triangular facades for esthetic and functional uses.

2. Description of the Prior Art

Orthogonal and circular shapes are well known forms of perimeter shapes of building structures commonly chosen in response to various considerations including the particular use intended, terrain features, construction materials available, costs and esthetics. Disregarding the roof for functional reasons only, a square or a rectangular box-like structure is believed the most common choice to accommodate the designed height for one or more floors of a building. Circular structures, with or without geodetic domes, pyramids or other geometric shapes also are well known. Typically, all orthogonal and circular shapes are designed with a prominent front entrance and built on a surface slab or a foundation extending below ground level. The interior layout of building structures also is subject to many considerations and choices. The preferred choice may vary from time to time and the same is true for both the exterior and interior finishing details or styles of such structures. It is known in the art to accommodate various design and construction problems due to inclined terrain features requiring adaptation to accommodate the degree of the ground slope. Examples of such prior art are found in Ferguson et al. U.S. Pat. No. 4,807,418; Lamarca U.S. Pat. No. 4,594,825; Helfrich U.S. Pat. No. 3,913,285; Levenson U.S. Pat. No. 3,724,147; and Tourtellotte U.S. Pat. No. 2,241,830.

Accordingly, it is an object of the present invention to provide a static building structure embodying at least three triangularly shaped facades interrelated according to a particular arrangement orientanable in three-dimensional space to form any one of a multitude of architectural configurations suitable for structures to be erected on either level land or undulating terrain.

It is another object of the present invention to provide a triangular complex of the three triangularly shaped facades in a building structure to allow the use of any of a variety of types of foundations including a monolithic slab or more extensive foundation structures suitable for installation on land with or without an undulating terrain having an acutely angled mean slope well suited to the facades at an angle of 45° without modification to the triangular complex of the facades.

It is a further object of the present invention to provide a building structure combining into the structure at least three triangularly shaped facades each having two angling sidewalls, preferably of equal length and angled with the third sidewall preferably at an included angle of 45°.

It is another object of the present invention to provide a building structure combining at least three triangularly shaped facades with one or more of the facades having angled sidewalls that may embody a truncated configuration to eliminate a triangular segment of the included acute angle at one or both ends of the facades.

It is another object of the present invention to provide a building structure combining at least three triangularly shaped facades to establish a basic perimeter design allowing enlargement by resizing and/or addition of a variety of diversely orientated static structures to accommodate without compromise foundation details, interior supporting structure, room layouts, and exterior or interior finished appearance.

SUMMARY OF THE INVENTION

More particularly, according to the present invention there is provided a building structure having an array of first, second and third triangular facades with said second triangular facade jutting from side boundaries of each of said first and third triangular facades. Preferably, the aforementioned array of first, second and third triangular facades occur in a serial fashion dispersed about an elongated central axis. An important feature of the present invention allows the orientation of the elongated central axis in any of perpendicular, parallel, or angular planes to the horizontal and allows the use of variable foundation structures without modification to the triangular complex of the facades.

In one preferred form of the present invention, an array of at least three building elements arranged mutually contiguous along an elongated central axis, with each of the building elements having a linear boundary substantially contiguous with a linear boundary of at least another one of the building element structures, each of the building elements having three peripheral boundaries including at least one boundary terminating at an angular relation with boundaries for forming triangular boundary walls between opposed boundary walls.

BRIEF DESCRIPTION OF THE SEVERAL VIEWS OF THE DRAWINGS

The present invention will be more fully understood when the following description is read in light of the accompanying drawings in which:

FIG. 1 is a front elevational view of a first embodiment of a building embodying the features of the present invention;

FIG. 2 is a top plan view of the embodiment of the building shown in FIG. 1;

FIG. 3 is a perspective view taken from a front/right hand position in the illustration of FIG. 1;

FIG. 4 is a perspective view taken from a front/left hand position in the illustration of FIG. 1;

DETAILED DESCRIPTION OF THE INVENTION

Figure 5:
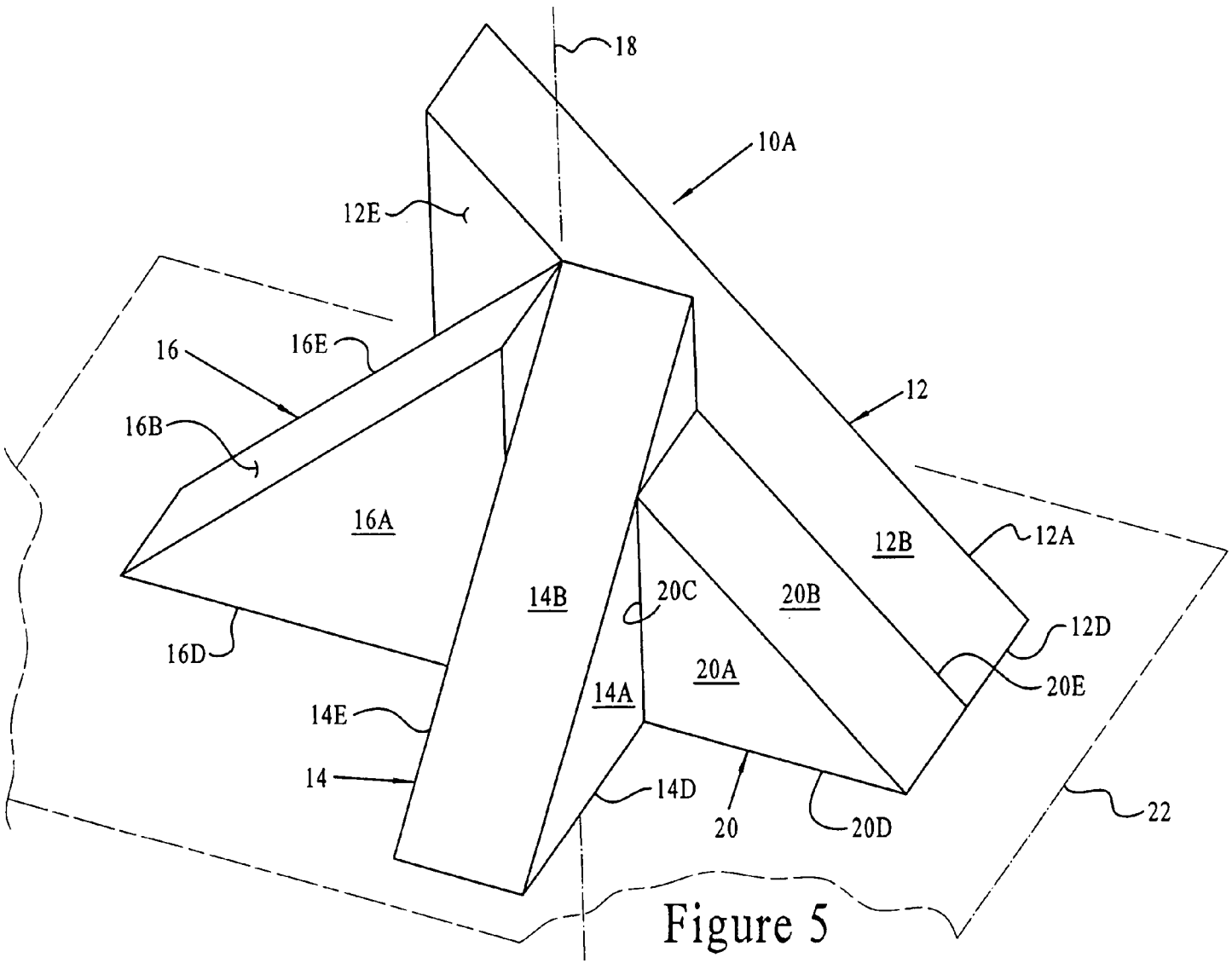
FIG. 5 is a perspective view similar to FIG. 3 taken from a front/right hand position in the illustration of a second embodiment of a building embodying the features of the present invention.

FIGS. 1, 2, 3, and 4 schematically illustrate a building 10 according to a first embodiment of the present invention. The basic architecture of the building 10 features the provision of three triangular facades 12, 14 and 16 uniquely arranged in a serial array formed by the triangular facade 14 jutting from side face boundaries of each of the abutted and side by side triangular facades 12 and 16. The three triangular facades 12, 14 and 16 are all similarly configured in the dispersed serial arrangement about an elongated central axis 18. Thus, the three triangular facades 12, 14 and 16 become first, second and third triangularly shaped building elements according to the present invention. The triangular façade 12, the larger of triangular facades, has a triangularly shaped outer facing wall 12A bounded by an endless succession of perimeter walls 12B, 12C, and 12D in a right triangle relation. A triangularly shaped inner facing wall 12E is merged with each of a portion of a triangularly shaped inner facing wall 16E of the façade 16 and a portion of a perimeter wall 14C of the façade 14. The relative sizes of the triangular façades 14 and 16 are preferably the same. The perimeter wall 14C of the façade 14 forms a right triangle relation in an endless succession of additional perimeter walls 14B and 14D. The triangular façade 16 further includes a triangularly shaped outer facing wall 16A bounded by an endless succession of perimeter walls 16B, 16C, and 16D in a right triangle relation. The triangularly shaped inner facing wall 12E of triangular façade 12 is disposed in the array of triangular façades such that a portion of wall 12E projects from each of opposite lateral sides of the triangular façade 14. A further relationship between the facades is seen by the relation that the triangular facades 12 and 16 project laterally from the triangularly shaped outer facing wall 14A and triangularly shaped inner facing 14E, respectively, of triangular façade 14.

In the right triangular arraignment, the perimeter wall 12B is the hypotenuse and the perimeter walls 12C and 12D intersect with the wall 12B at included angles of 45 degrees. In the right triangular arrangement the perimeter walls 12B, 14B, and 16B, the perimeter wall 14B is the hypotenuse and the perimeter walls 14C and 14D intersect with the wall 14B at included angles of 45 degrees. The triangularly shaped outer facing wall 16A is bounded by perimeter walls 16B, 16C, and 16D at an angular relation preferably corresponding to a right triangle. A portion of a triangular shaped inner facing wall 16E joined with the structure of the façades 12 and 14 forms an enclosure to the remaining interior of the façade 16. In the façades 12, 14, and 16, the right triangular arrangement of perimeter walls 12B, 14B, and 16B is each the hypotenuse and the remaining perimeter walls intersect at included angles of 45 degrees. It is to be understood that the right triangular arraignment of facades 12, 14 and 16 are specific examples of suitable triangularly shaped facades and that other triangular configurations with acute and obtuse included angles may be utilized without departing from the present invention.

In FIG. 1 the perimeter walls 12D, 14D and 16D are foundation orientated with the length of walls 14D and 16D being the same while 12D is longer and triangularly shaped inner facing walls 14E and 16E extending to the same height but only partly exists because of the adjoining relationship of the three facades 12, 14 and 16. The triangularly shaped inner facing wall 12E also only partly exists and has an extended height longer than the extended height of triangularly shaped inner facing walls 14E and 16E. For purpose of illustration of the facades 12, 14 and 16 the length of the foundation orientated perimeter walls, 14D and 16D can each extend three units of length and the foundation orientated perimeter wall 12D extend four units of length. Each unit can equal any desired increment of length within a range beginning at, for example, a unit equal to ten feet and the upper limit constrained only by local ordnance, topography, costs and like factors. The triangularly shaped inner facing walls 14E and 16E will extend to the corresponding height of three units and the triangularly shaped inner facing wall 12E will extend upwardly four units. The width of the facades 12, 14 and 16 can all be the same or different, as desired, and in the illustrated example of FIGS. 1–4, the proportions are shown as one unit of width which for illustration purposes only is of the order of fifteen feet.

The facades 12, 14 and 16 are arranged, as shown, in an interrelated relationship. The facades are mutually contiguous along the elongated central axis 18 by arranging the facade 14 in a right angle relation to the facade 12 at a location along the triangularly shaped inner facing wall 12E preferably where the three units of height of the triangularly shaped inner facing wall 14E terminate at the slope of perimeter wall 12B. This relationship establishes the site of the juncture with the facade 16 and the mutually contiguous relationship with the elongated central axis 18. The façade 16 is positioned parallel and adjacent facade 12 but with the 45° slope of the perimeter wall 16B inclined in the opposite direction from that of the slope of the perimeter wall 12B so that the 45° inclined slope would coincide with the elongated central axis 18. The first, second and third triangularly shaped facades formed as building elements having a principal boundary comprised of perimeter wall 14C and triangularly shaped inner facing walls 12E and 16E lie in planes and substantially mutually parallel.

In the event it is desired to increase the length of the perimeter walls 16B, 16C and 16D of the facade 16 nonetheless the newly dimensioned façade is to be placed in the same position so that the slope line of the perimeter wall 16B intersects with the elongated central axis 18 at the junction with the facades 12 and 14. Thus, it can be seen that the facade 16 is arranged so that the juncture with facade 14 is at right angle and the juncture with façade 12 partly obscured or eliminated by the overlying part of the triangularly shaped inner facing wall 12E. The length, height, and width of the facades may be chosen and altered to meet the need for varying interior space requirements. The length of perimeter walls 12B, 12C, and 12D of the facade 12 are each intended to be a minimum of one unit larger than the length of the corresponding perimeter wall of facades 14 and 16.

FIG. 5 illustrates a building 10A having a fourth façade 20 added as an option to the triangular array of facades 12, 14 and 16 and thus, adding another triangularly shaped building element as just described and shown in FIGS. 1–4 according to the present invention. The relative size of the façade 20 is optional and, if desired as shown in FIG. 5, constructed as an extension or enlargement to that part of façade 12, which protrudes from the intersection with façade 14 at the side opposite to and parallel with façade 16. The façade 20 is triangular with a triangularly shaped inner facing wall 20A facing outwardly from a juncture plane coinciding with wall 12E of facade 12. A peripheral boundary wall 20B takes the form of the hypotenuse of the triangular configuration that further includes peripheral walls 20C and 20D. Wall 20D is joined with the triangularly shaped outer facing wall 14A. Lastly, the facade 20 includes a triangularly shaped inner facing wall 20E, which is perceptible only when wall 20E is dimensioned to extend beyond the confronting part of the triangularly shaped inner facing wall 12E. The triangular configuration of the façade 20 need not match the configuration of the adjoining portion of façade 12 and may be advantageously modified.

Figure 6:
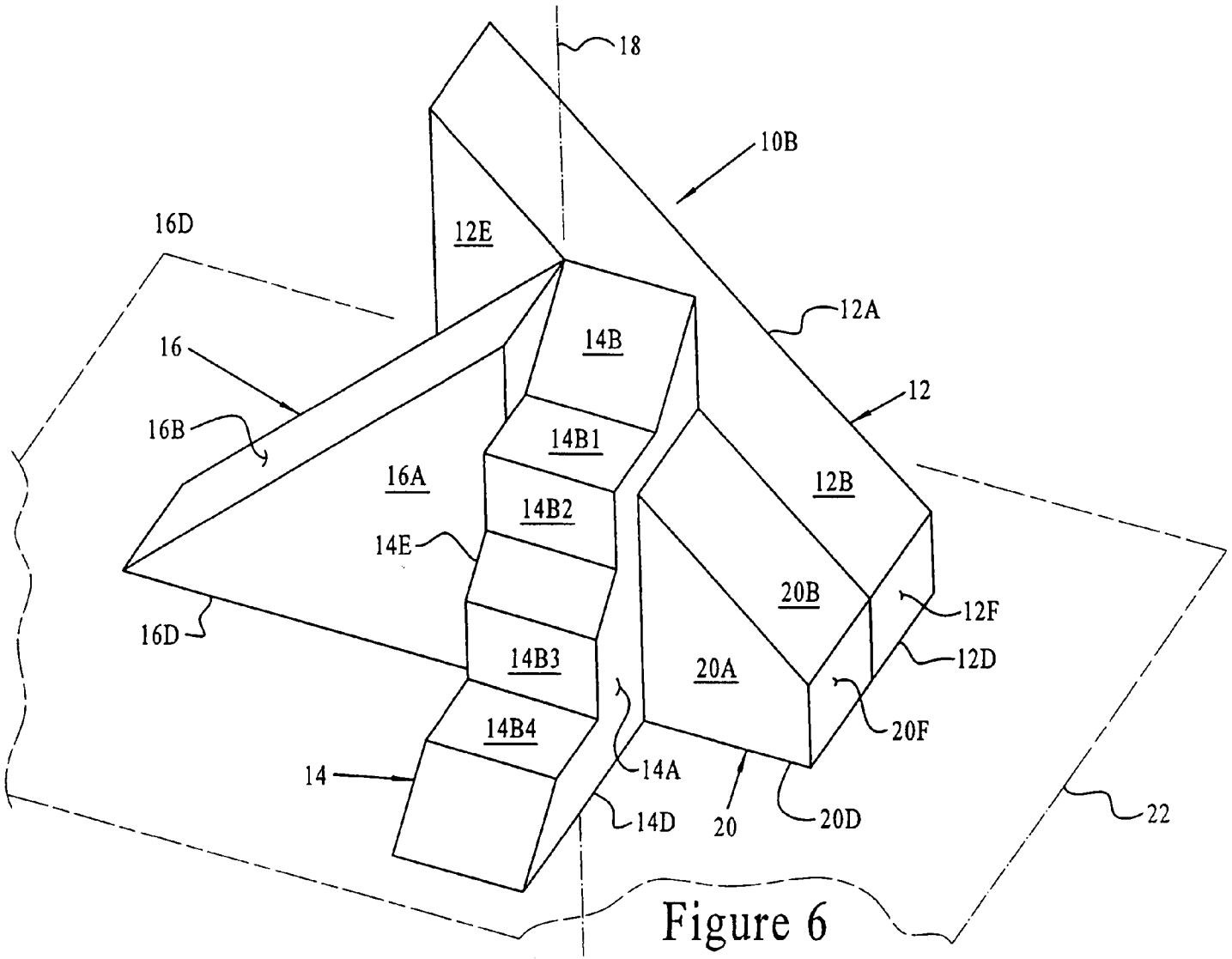
FIG. 6 is a perspective view similar to FIG. 5 taken from a front/right hand position in the illustration of a third embodiment of a building embodying the features of the present invention.

In the third embodiment of the present invention shown in FIG. 6, the building 10B incorporates diverse modifications as compared to the configuration of the building 10A.

One form of modification is the addition of peripheral boundary walls 12F and 20F of the respective façades 12 and 20. The truncation such as a fore shorting of the base ends angling at 45° to provide the peripheral boundary walls 12F and 20F of the respective façades 12 and 20 provide added design opportunities for portal entranceways and landscaping. A second form of modification is the addition of protruding horizontal wall segment 14B1 and perpendicular wall segment 14B2 arranged at the extended end portion of perimeter wall 14B to form an orthogonal enlargement and provide, for example, that wall segment 14B2 takes the form of a vertical wall containing windows, doors, or similar well-known building amenities. A third form of modification is the addition of internally extending perimeter wall segments 14B3 and 14B4 at a site along perimeter wall 14B to form a step like cavity along the wall 14B. The cavity alters the triangular appearance to the triangular shape outer facing wall 14A and triangular shaped inner facing wall 14E. Thus, the perimeter wall segments 14B3 and 14B4 eliminate an intermediate length of the slope at, for example, 45 degrees without truncating. These three forms of modification are equally applicable to the perimeter walls of all of the facades 12, 14, 16 and 20 within the scope of the present invention.

It is only a matter of convenience for illustrating each of the first three embodiments of the present invention as shown in FIGS. 1–6 that the elongated central axis 18 is perpendicularly orientated relative to a common reference plane 22 containing each of the peripheral boundary walls 12D, 14D, 16D, and 20D. The orientation of the triangular array of facades 12, 14, 16 and 20 in addition to lying along the reference plane 22 is further characterized by the fact that the reference plane 22 can be coextensive with flat terrain or lie in a plane sloping at any desired angle to the reference plane. Additionally the triangular array of facades may be rotated about the elongated central axis 18 through any desired angle to orientate features of the triangular facades or a particular element of a façade to greatest structural and/or esthetic advantage. Thus, the elongated central axis 18 can be orientated to extend perpendicular, parallel or within angular planes to the reference plane 22. The reference plane 22 is especially useful to present the triangular array of facades for desired purposes whereby the buildings 10, 10A, or 10B illustrated in FIGS. 1–6 may reside in a chosen orientation on either level land or undulating terrain. This choice of the angular orientation of axis 18 in space further enhances the usefulness of the triangular configuration of the façades, particularly to bring one or more jutting structural components to bear on a foundation for supporting a part or all of the facades. The exposure of the walls 12D, 14D, 16D, and/or 20D to the atmosphere is then a visual part of the triangular array.

Figure 7:
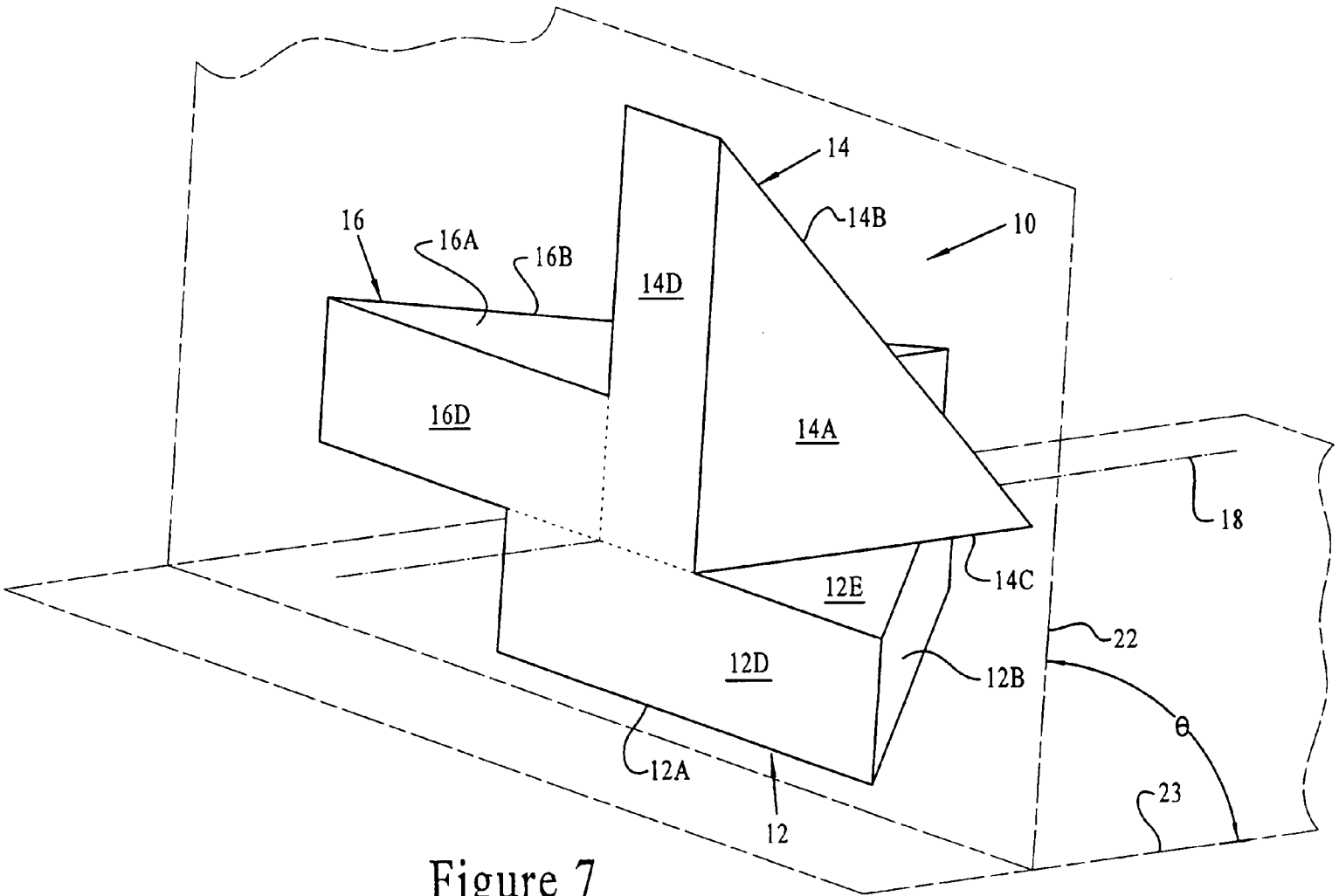
FIG. 7 illustrates a reorientation of facades according to the embodiment of FIGS. 1–4 to serve as the front of a building according to the present invention.

FIG. 7 illustrates one of a plurality of distinctive orientations of facades to serve as the front entrance to the building 10 and, if desired, buildings 10A and 10B. The addition of a forth façade 20; truncation of the facades of the buildings 10A and 10B, respectively; and alterations to the façade profile as described and shown in FIG. 6 are applicable to a desired orientation of the building, particularly for placement of the building on sloping terrain. In FIG. 7, the reference plane 22 containing walls 12D, 14D, and 16D forms an angle θ with a plane 23 generally co-planer with the ground plane of the surrounding terrain. The angle θ in the illustration of FIG. 7 is 90 degrees and the axis 18 is parallel to plane 23. The triangularly shaped outer facing wall 14A upstanding from wall 12E is orientated generally perpendicular or acutely angled to the plane 23 and triangularly shaped outer facing wall 16A of facade 16 is parallel with the plane 23. This configuration of the building 10 is particularly suitable for construction and use on level or slightly sloping terrain.

Figure 8:
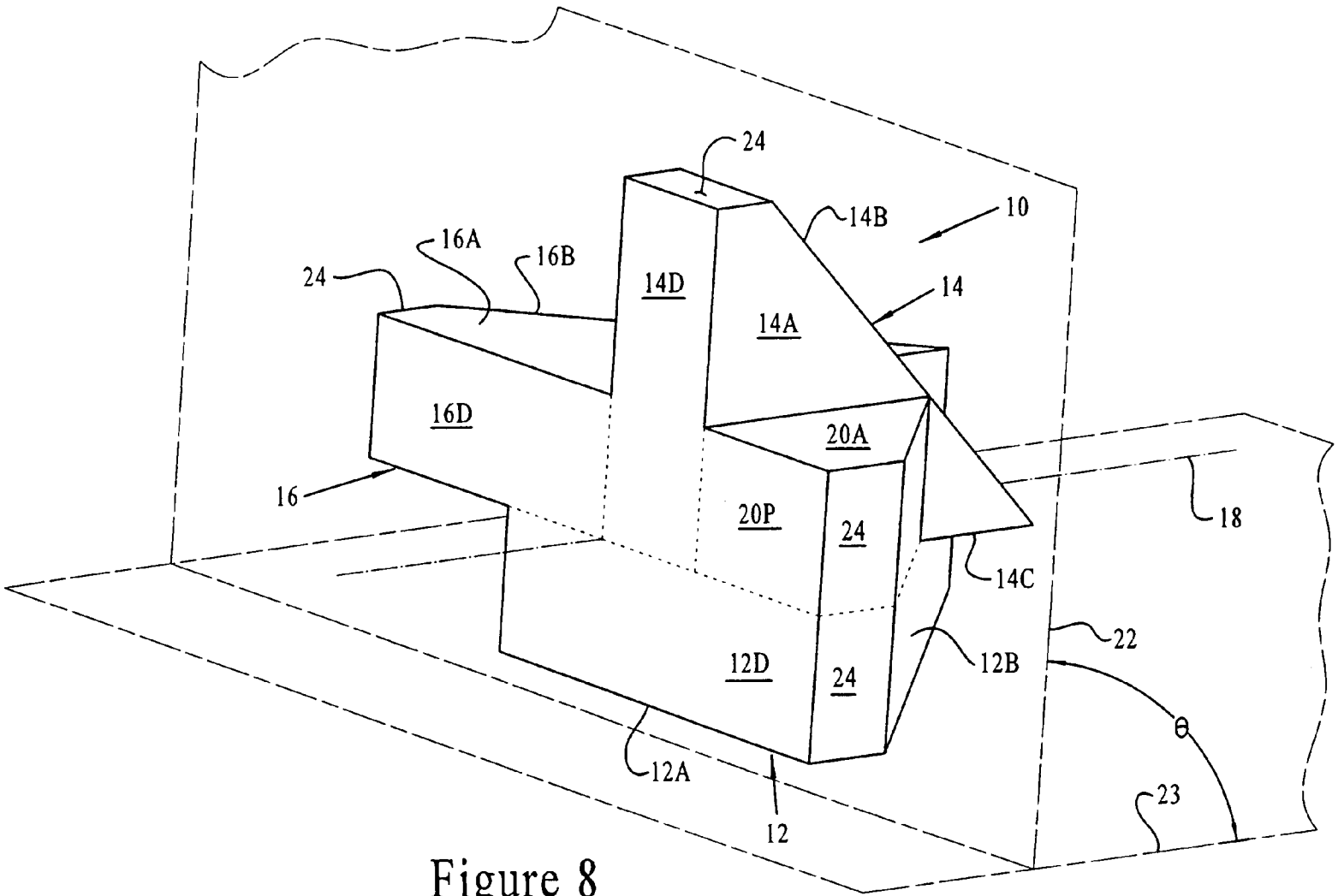
FIG. 8 illustrates a reorientation of facades according to the embodiment of FIG. 5 to serve as the front of a building according to the present invention.

In FIG. 8, the facades 12, 14, and 16 of the building shown in FIG. 7 are modified by the addition of façade 20 and truncating the acutely shaped terminal end portions of walls 12B, 14B, 16B, and 20B at each of the sites identified by reference numeral 24. The triangularly end portions at the junctions of perimeter walls 12B–12C; 14B–14C; 16B–16C; and 20B–20C may, if desired be truncated to provide additional sites 24. The angle θ in the illustration of FIG. 8 is also 90 degrees and the axis 18 is parallel to plane 23.

Figure 9:
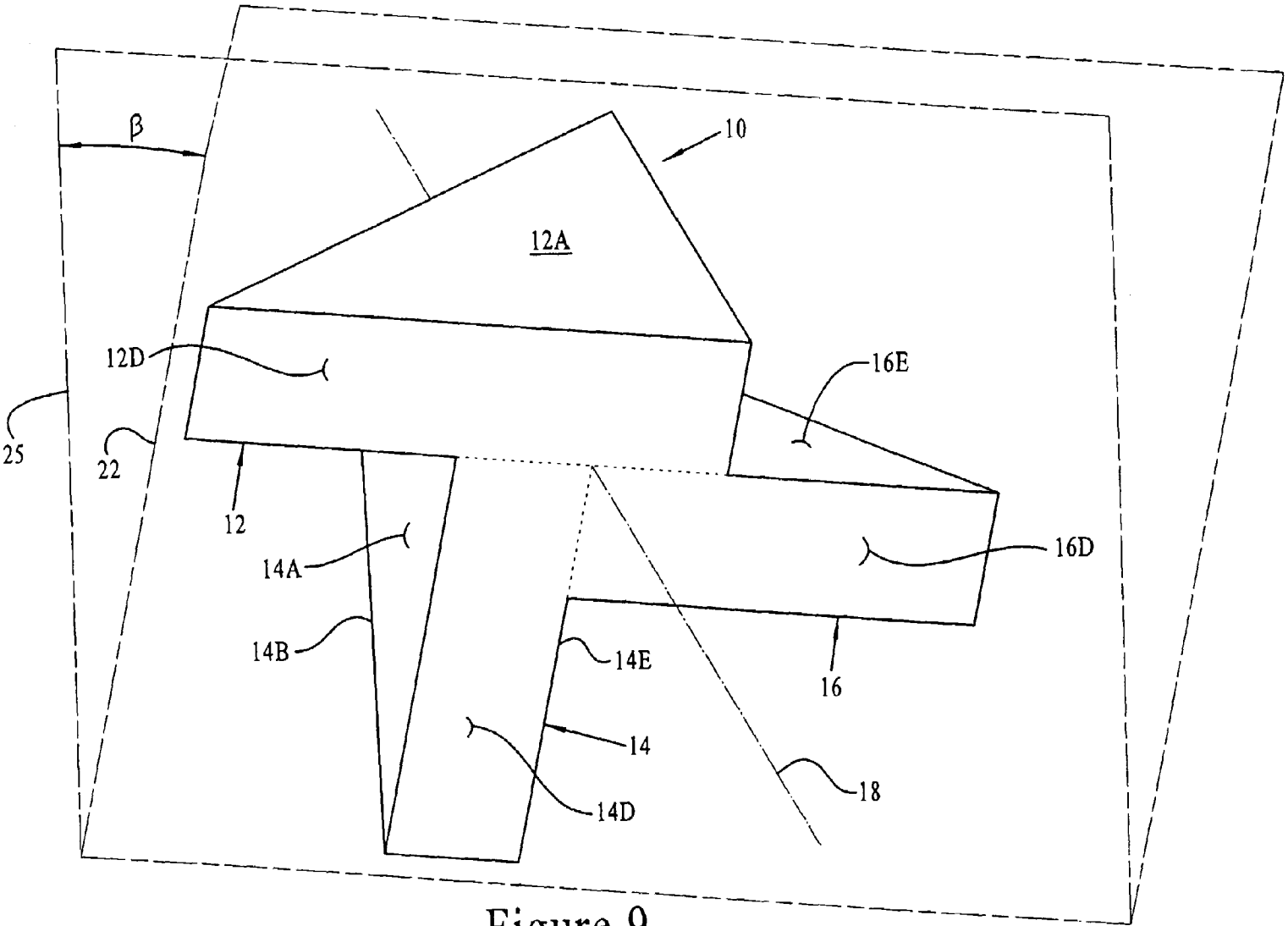
FIG. 9 illustrates another reorientation of facades according to the embodiment of FIGS. 1–4 so that a perimeter wall angles to conform to an acutely sloping contour of the terrain according to the present invention.

In FIG. 9, the orientation of building 10 is altered in a way that perimeter wall 14B of façade 14 lies in a plane 25 forming an angle θ relative to the reference plane 22 to conform to a sloping contour of the terrain containing a suitable foundation to support the building. Typically, the angle β is an acute angle in a range of up to 45 degree, although an angle greater that 45 degrees is within the scope of the present invention. The elongated central axis 18 extends in a perpendicular relation to the reference plane 22. A foundation for the building uses well-known and accepted engineering technology and applicable governmental regulations using sufficient subterranean implantation to sustain the static load of the building. The construction of the foundation may require alteration to the slope of perimeter wall 14B and alteration to the configuration of the triangularly shaped outer and inner facing walls 14A and 14E, respectively. These alterations while structural, will not alter the appearance of the walls 14A and 14E appearing above the sloping terrain as generally lying within the plane 25. The triangular facades of the building according to the embodiment of FIG. 9 offers an architectural design allowing the perimeter walls 12D, 14D, and 16D in the plane 22 directed toward the surrounding terrain to producing a remarkable and distinct appearance to the building and maximize views of the surrounding terrain.

Figure 10:
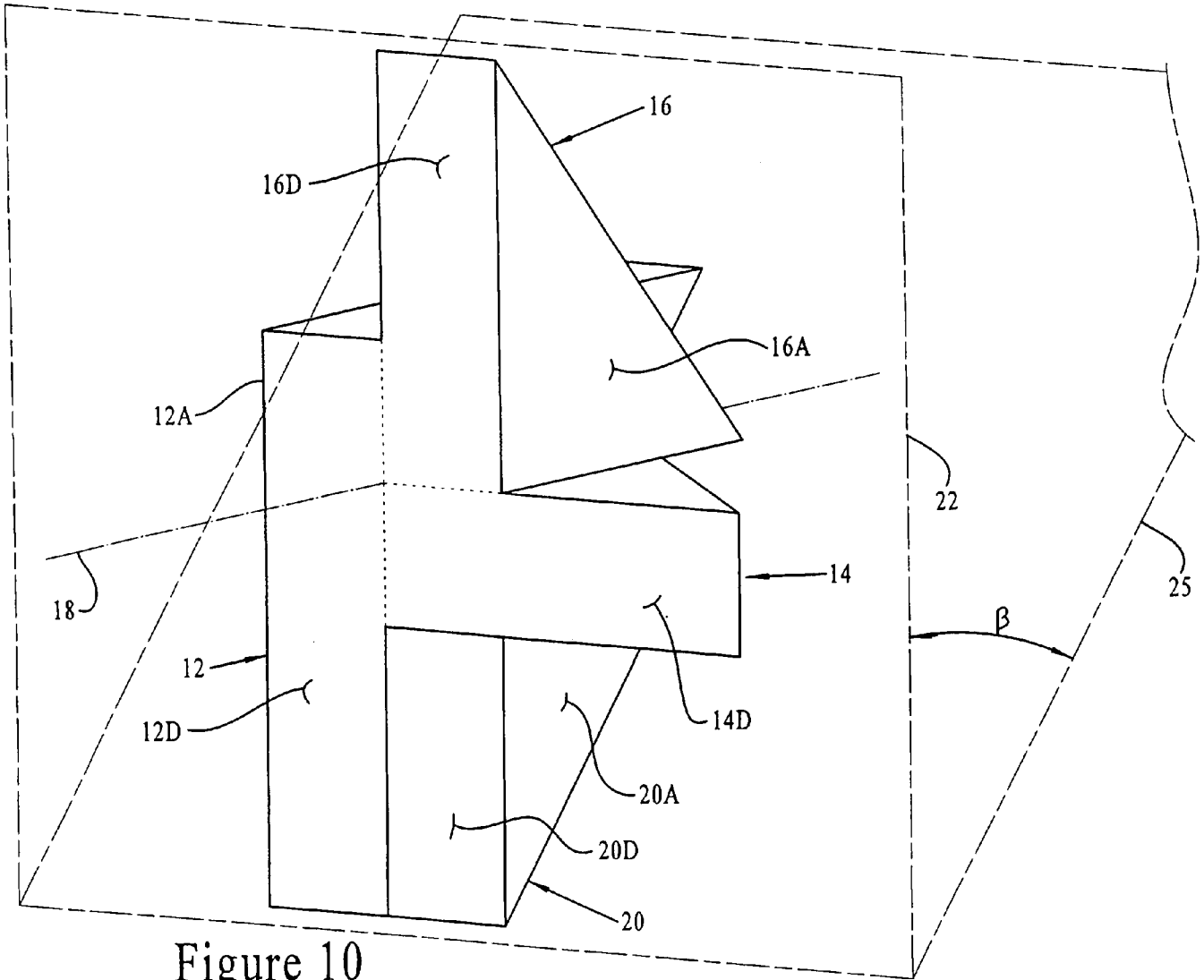
FIG. 10 illustrates another reorientation of facades according to the embodiment of FIG. 5 to orientate a building so that a perimeter wall angles to conform to a sloping contour of the terrain according to the present invention.

FIG. 10 illustrates a further arrangement of the building 10A according to the present invention characterized by orientating the facades so that the reference plane 22 is vertically orientates and the perimeter walls 12D, 14D, 16D, and 20D face outwardly across the horizon in the horizontal direction along the axis 18. The reference plane 22 is set at an angle β to the plane 25. Access to the interior of the building from the exterior surroundings through perimeter walls is enhanced through a generous use of glass enclosures such as windows, doors and the like. The orientation of the triangular facade 14 jutting from side boundaries of each of triangular facades 12, 16, and 20 that are generally horizontally orientated permits convenient access from the surrounding terrain. This arrangement of the building is particularly advantageous for a residential dwelling and provides passages for garaging automobiles and people doors, particularly for access to patios and the like appended facilities for the building.

Additionally, the triangularly shaped outer facing walls 16A and 20A can be useful to provide porch areas with unimpeded access and exposure at opposite sides of the jutting triangular facade 14.

Figure 11:
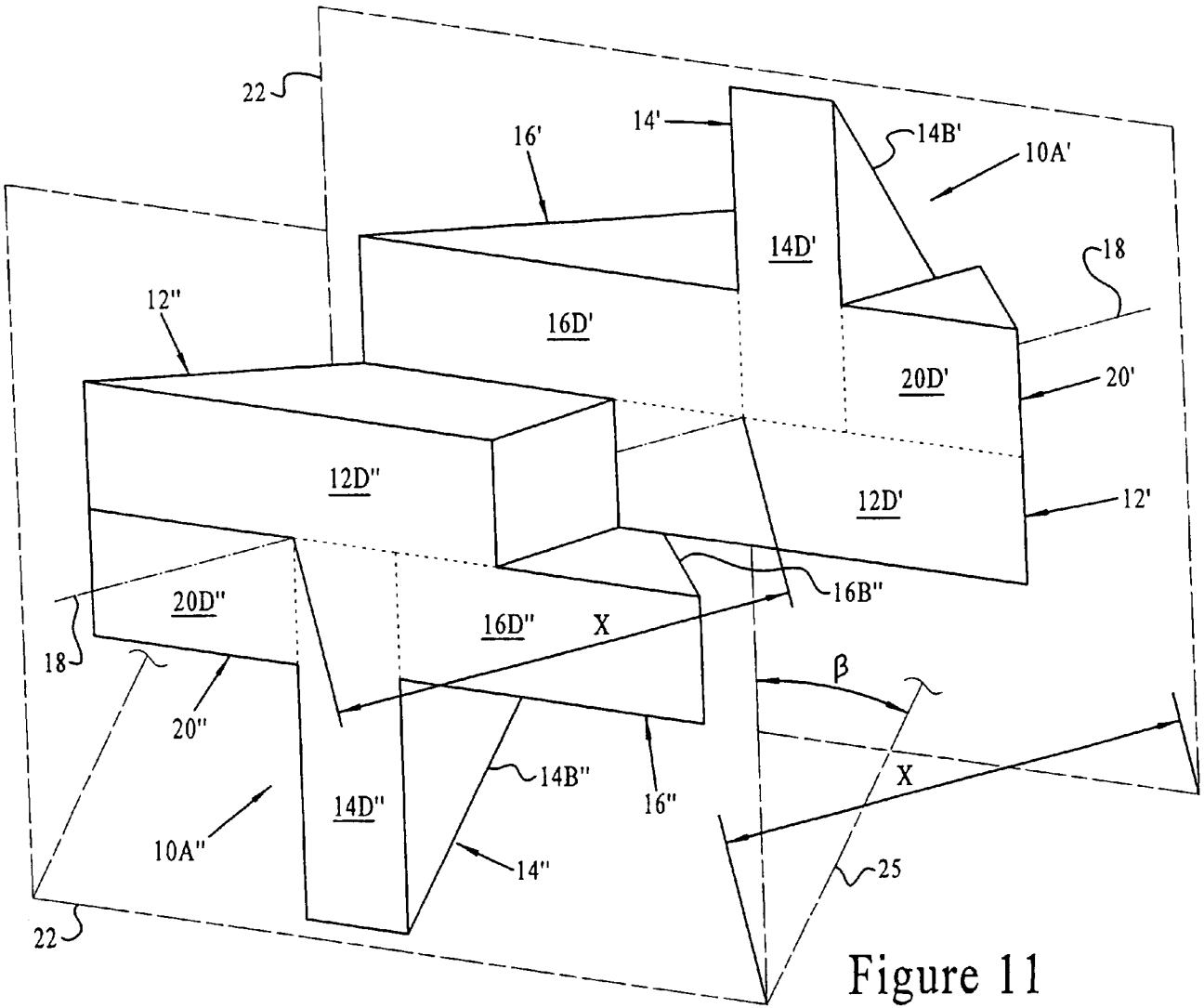
FIG. 11 illustrates a further reorientation of multiple facades according to the embodiment of FIG. 5 to orientate a combination of two buildings with the perimeter walls of each angled to conform to a sloping contour of the terrain according to the present invention.

FIG. 11 illustrates a multi facade dwelling comprised of two buildings 10A' and 10A" arranged in a superimposed and inverted relation. The buildings 10A' and 10A" each consist of the same component facades 12, 14, 16, and 20 arranged in the same manner as described and shown in FIG. 5 but the orientation of the dwelling is illustrated on sloping terrain as generally lying within the plane 25 to further exhibit the distinctive features of the facades. The facades 14' and 14" of each of the buildings 10A' and 10A" extend in opposite vertical directions. The reference planes 22' and 22" are generally vertically orientated and offset by a distance X whereby reference plane 22' containing walls 12D', 14D', 16D' and 20D' of the building 10A' are forwardly from a receded location of a generally vertical plane 22" containing walls 12D", 14D", 16D" and 20D" of the building 10A". The jutting vertically of each of the facades 14' and 14" from the remaining facades presents the peripheral boundary walls of these facades for added design opportunities to include portal entranceways, garden area courtyard, and landscaping. In this position, the facades 12' and 12" are jutting horizontally and facades 14' and 14" are vertically orientated by extending downward away from facades 12' and 12" and 16' and 16". The dwelling illustrated in FIG. 11 on sloping terrain uses the distinctive features of the facades for locating a foundation to receive a truncated end face extending between walls 12' –12D" of facades 12' and 12"; walls 16B' and 16D" of facades 16' and 16" and walls 20B' and 20D" of the facades 20' and 20". It is within the scope of the present invention to orientate the dwelling shown in FIG. 11 in an intermediate position on the inclined terrain whereby a base of the building is formed by truncated ends of façades with the façades 14' and 14" jutting in a horizontal orientation.

Figure 12:
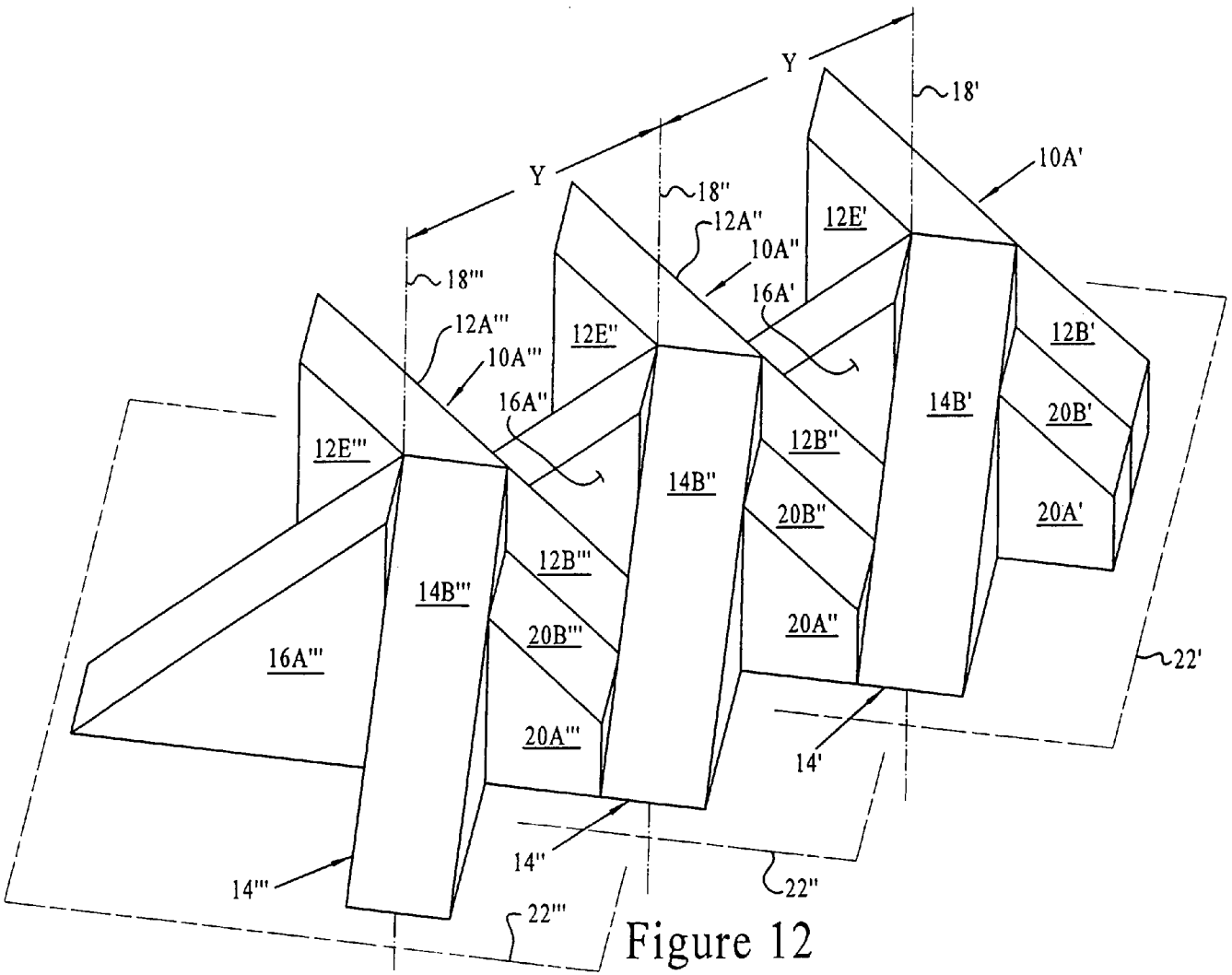
FIG. 12 illustrates a further reorientation of multiple facades according to the embodiment of FIGS. 1–4 according to the present invention.

FIG. 12 illustrates a further embodiment of a multi facade structure comprised of three buildings 10A', 10A" and 10A'" arranged in a tandem relation. The buildings consist of the same component facades as described and shown in FIG. 5 but the orientations of the buildings 10A', 10A" and 10A'" are such that the planes 22', 22" and 22'", respectively, are generally parallel and for the purpose of illustration only are co-planer and horizontal. The facades 14', 14" and 14'" are arranged to jut at spaced apart and parallel locations along the successively occurring buildings 10A', 10A" and 10A'". The axes 18', 18", and 18'" are set apart at a pitch distance identified by reference character Y that is arbitral and selected as the same distance in the illustration of FIG. 12. The walls 12A" and 12A'" confront and can be spaced from or, if desired, share a portion of the common surface areas at the junction with the walls 16A' and 16A", respectively.

Buildings according to the present invention may be used for any desired purpose. In all of the foregoing orientations of the buildings, the façades offer design opportunities for configurations of the interior space and to permit multiple levels of horizontal floors. The ground space adjacent to the triangularly shaped outer facing walls and the triangularly shaped inner facing walls of the facades as illustrated are useful to increase the size of the building by adding one or more additional facades preferably embodying the features of the present invention.

While the foregoing illustrations of ways in which the building design may be utilized are based on using one building with suitable dimensions for the intended use, it should be understood that such is not mandatory as the dimensions are intended to be a variable depending upon the need for floor space or terrain influence. For example, facade 16 could be any of ten, fourteen, or twenty feet wide while facade 14 could be twenty-four feet wide and the same is true for facades 12 and 20. Such dimensional choices are only desired dimensional adjustments to accommodate the use intended for the interior space in a particular façade or because of the terrain. The nature of the building of the present invention is useful for a modular design such that a building also can be constructed where the modular design is enlarged or repeated as an identical adjacent cluster or opposed structures. Such combinations may be particularly useful in the design of a row of single or multifamily townhouses or apartments or, commercial space.

While the present invention has been described in connection with the preferred embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

The invention claimed is:

1. A building comprising a static building structure having a basic architecture including the combination of a serial array of first, second and third triangularly shaped building elements erected on either level or undulating terrain such that said second triangularly shaped building element has triangular shaped sides bounded by a perimeter wall boundary jutting as an angular projection from an elongated central axis at the junction of triangular shaped side boundaries of each of said first, second and third triangularly shaped building elements, said first triangularly shaped building element being disposed in said serial array to project from each of opposite lateral sides of said second triangularly shaped building element.

2. The building according to claim 1 wherein said first and third triangular shaped building element each project from one of each of opposite triangular shaped sides of said second triangularly shaped building element.

3. A building comprising a static building structure having a basic architecture including the combination of a serial array of first, second and third triangularly shaped building elements erected on either level or undulating terrain such that said second triangularly shaped building element has triangular shaped sides bounded by a perimeter wall boundary jutting as an angular projection from an elongated central axis at the junction of triangular shaped side boundaries of each of said first, second and third triangularly shaped building elements said first triangularly shaped building element being disposed in said serial array to project from each of opposite lateral sides of said second triangularly shaped building element, and a fourth triangularly shaped building element having a triangularly shaped side boundary coextensive with at least a portion of said third triangularly shaped building element and projecting from said second triangularly shaped building element.

4. The building according to claim 1 wherein said array of first, second and third triangularly shaped building elements occur in a serial fashion dispersed about said elongated central axis.

5. The building according to claim 3 wherein said elongated central axis is further defined as a longitudinal central axis orientated in any of perpendicular, parallel, or angular planes to the horizontal.

6. The building according to claim 1 wherein each of said first, second and third triangularly shaped building elements each include a perimeter wall lying in a common reference plane.

7. The building according to claim 6 wherein said common reference plane is foundation orientated on said terrain.

8. The building according to claim 6 wherein said common reference plane forms an acute angle with a reference plane generally containing said terrain surrounding said triangularly shaped building elements.

9. The building according to claim 1 further including a second array of said first, second and third triangularly shaped building elements such that said second triangularly shaped building element has triangular shaped sides bounded by a perimeter wall boundary of said second array jutting as an annular projection from triangular side boundaries of each of said first and third triangularly shaped building elements of the second array.

10. The building according to claim 9 wherein said second triangularly shaped building element of said second array and said second triangularly shaped building element of the first said serial array extend in opposite vertical directions.

11. The building according to claim 9 wherein each of said first, second and third triangularly shaped building elements of the first said serial array include a perimeter wall lying in a first common reference plane and said second array include a perimeter wall lying in a second common reference plane.

12. The building according to claim 11 wherein said first common reference plane and said second common reference plane are co-planer.

13. The building according to claim 11 wherein said first common reference plane and said second common reference plane are generally parallel and spaced apart.

14. The building according to claim 11 wherein said first common reference plane and said second common reference plane each form an acute angle with a reference plane generally containing said terrain surrounding said first triangularly shaped building element and second triangularly shaped building element.

15. The building according to claim 1 wherein the first said serial array of triangularly shaped building elements occurs in a serial fashion dispersed about a first elongated central axis and a second array of triangularly shaped building elements occurs in a serial fashion dispersed about a second elongated central axis, said first central axis and said second central axis being generally parallel and set apart at a pitch distance such that walls of the triangular facades confront each other.

16. A building comprising a static building structure having a basic architecture including the combination of an array of at least three building elements arranged mutually contiguous along an elongated central axis, a second of said three building elements having an angular projecting boundary jutting from said elongated central axis at the junction of side boundaries of each of a first and a third of said three building elements, each of the building elements having a linear boundary substantially contiguous with a linear boundary of at least another one of said building element structures, each of said building elements having three peripheral boundaries including at least one boundary terminating at an angular relation with boundaries for forming triangular boundary walls between opposed boundary walls, said array of at least three building elements defining first, second and third triangularly shaped building elements erected on either level or undulating terrain such that said first triangular shaped building element disposed in a serial array to project from each of opposite lateral sides of said second triangularly shaped building element and said second triangularly shaped building element having an angular projecting boundary jutting from an elongated central axis at the junction of side boundaries of each of said first and third triangularly shaped building elements.

17. A building comprising a static building structure having a basic architecture including the combination of first, second and third triangularly shaped building elements each with five principal peripheral boundaries arranged in an array formed by said first triangularly shaped building element having boundaries partly contiguous with said second and third triangularly shaped building elements and said second triangularly shaped building element having a boundary partly contiguous with said third triangularly shaped building element, each of said building elements having at least two principal peripheral boundaries forming an acute angular relation there between, said first, second and third triangularly shaped building elements having a principal boundary lying in a plane and substantially mutually parallel.

18. A building comprising a static building structure having a basic architecture including the combination of an array of at least three triangularly shaped building elements each having a boundary substantially contiguous with a boundary of at least another one of said building elements, each of said building elements having three principal peripheral boundaries defined by at least one boundary forming an acute angular relation with each of the two remaining boundaries, said three triangularly shaped building elements defining first, second and third triangularly shaped building elements erected on either level or undulating terrain such that said first triangularly shaped building element disposed in a serial array to project from each of opposite lateral sides of said second triangularly shaped building element and said second triangularly shaped building element has triangular shaped sides bounded by a perimeter wall boundary jutting as an angular protection from an elongated central axis at the junction of triangular shaped side boundaries of each of said first, second and third triangularly shaped building elements.

19. The building according to claim 18 wherein said three triangularly shaped building elements are mutually contiguous along an elongated central axis, and wherein each of said building elements include triangular boundary walls between opposed edges of periphery boundary walls thereof.

20. A building comprising a static building structure having a basic architecture including the combination of first, second and third triangularly shaped building elements each with five principal peripheral boundaries arranged in an array formed by said first triangularly shaped building element having boundaries substantially contiguous with said second and third triangularly shaped building elements and said second triangularly shaped building element having a boundary substantially contiguous with said third triangularly shaped building element, each of said building elements having at least two principal peripheral boundaries forming an acute angular relation there between, a second of said three triangularly shaped building elements having an angular projecting boundary jutting from side boundaries of each of a first and a third of said three triangularly shaped building elements, said first, second and third triangularly shaped building elements defining first, second and, third triangularly shaped building elements erected on either level or undulating terrain such that said first triangularly shaped building element disposed in a serial array to project from each of opposite triangular shaped sides of said second triangularly shaped building element and said second triangularly shaped building element having an angular projecting perimeter wall between said triangular shaped sides thereof jutting from an elongated central axis at the junction of triangular shaped side boundaries of each of said first, second and third triangularly shaped building elements.

21. A building comprising a static building structure having a basic architecture including the combination of an array of first, second and third triangularly shaped building elements erected on either level or undulating terrain such that said second triangularly shaped building element has triangular shaped sides bounded by a perimeter wall boundary jutting as an annular projection from side boundaries of each of said first and third triangularly shaped building element, said first triangularly shaped building element being disposed in said serial array to project from each of opposite lateral triangular shaped sides of said second triangularly shaped building element.

22. A building comprising a static building structure having a basic architecture including the combination of an array of first, second, third and forth triangularly shaped building elements erected on either level or undulating terrain such that said second triangularly shaped building element has triangular shaped sides bounded by perimeter wall jutting as an annular projection from side boundaries of each of said first and third triangularly shaped building elements, said fourth triangularly shaped building element being coextensive with at least a portion of said third triangularly shaped building element and projecting from said second triangularly shaped building element.

23. A building comprising a static building structure having a basic architecture including the combination of a first array and a second array of first, second and third triangularly shaped building elements erected on either level or undulating terrain such that said second triangularly shaped building element has triangular shaped sides bounded by a perimeter wall jutting as an annular projection from side boundaries of each of said first and third triangularly shaped building elements in each said first array and said second array, said triangularly shaped building elements including a perimeter wall lying in a foundation orientated common reference plane, said second triangularly shaped building element of said second array and said second triangularly shaped building element of the first said array extend in opposite vertical directions.

24. The building according to claim 23 wherein each of said first, second and third triangularly shaped building elements of the first said array includes a perimeter wall lying in a first common reference plane and said second array includes a perimeter wall lying in a second common reference plane.

25. The building according to claim 24 wherein said first common reference plane and said second common reference plane are co-planer.

26. The building according to claim 24 wherein said first common reference plane and said second common reference plane are generally parallel and spaced apart.

27. The building according to claim 24 wherein said first common reference plane and said second common reference plane each form an acute angle with a reference plane generally containing terrain surrounding said first triangularly shaped building element and second triangularly shaped building element.

28. The building according to claim 1 wherein at least one of said first, second and third triangularly shaped building elements includes a truncation to a triangular configuration.

29. The building according to claim 17 wherein at least one of said first, second and third triangularly shaped building elements includes a truncation to a triangular configuration.

30. The building according to claim 20 wherein at least one of said first, second and third triangularly shaped building elements includes a truncation to a triangular configuration.

31. A building comprising a static building structure having a basic architecture including the combination of an array of first, second and third triangularly shaped building elements erected on either level or undulating terrain such that said second triangularly shaped building element has triangular shaped sides bounded by a perimeter wall boundary jutting as an angular projection from an elongated central axis at the junction of triangularly shaped side boundaries of each of said first and third triangularly shaped building elements, and a second array of said first, second and third triangularly shaped building elements with said second triangularly shaped building element of said second array jutting from side boundaries of each of said first and third triangularly shaped building elements of the second array, wherein said second triangularly shaped building element of said second array and said second triangularly shaped building element of the first said array extend in opposite vertical directions.

32. The building according to claim 31 wherein each of said first, second and third triangularly shaped building elements of the first said serial array include a perimeter wall lying in a first common reference plane and said second array include a perimeter wall lying in a second common reference plane.

33. The building according to claim 32 wherein said first common reference plane and said second common reference plane are co-planer.

34. The building according to claim 32 wherein said first common reference plane and said second common reference plane are generally parallel and spaced apart.

35. The building according to claim 32 wherein said first common reference plane and said second common reference plane each form an acute angle with a reference plane generally containing said terrain surrounding said first triangularly shaped building element and second triangularly shaped building element.

* * * * *